US006076839A

United States Patent [19]

Pao-Hung

[11] Patent Number: 6,076,839

[45] Date of Patent: Jun. 20, 2000

[54] BABY WALKER WITH SAFETY BRAKE DEVICE

[76] Inventor: Lu Pao-Hung, No. 59-16, Chiu She Lane, Chui She Li, Pei Tun Dist., Taichung City, Taiwan

[21] Appl. No.: 09/128,267

[22] Filed: Aug. 3, 1998

[51] Int. Cl.[7] ..... B62B 9/08

[52] U.S. Cl. ..... 280/87.051; 188/5

[58] Field of Search ..... 280/87.051, 43.14, 280/43.18, 47.34, 87.05, 650, 33.994, 87.042; 188/5, 6, 7

[56] References Cited

U.S. PATENT DOCUMENTS

| | | | |
|---|---|---|---|
| 4,844,209 | 7/1989 | Sedlack | 280/87.051 |
| 5,586,622 | 12/1996 | Hu | 280/87.051 |
| 5,590,892 | 1/1997 | Hu | 280/87.051 |
| 5,899,471 | 5/1999 | Li-Wei | 280/87.051 |

*Primary Examiner*—Richard M. Camby

*Attorney, Agent, or Firm*—Harrison & Egbert

[57] ABSTRACT

A baby walker safety brake device including a wheel seat having a pivot hole and a slide way formed therein, a fixed guide wheel having a ring groove formed therein on one side thereof and having a shaft tube extend centrally therefrom, a shaft rod rotatably mounted in the shaft tube and received by the pivot hole of the wheel seat, and a fixed piece received within the ring groove of the fixed guide wheel. The fixed piece has a thickness matching a depth of the ring groove. The fixed piece has a central through hole extending around the shaft tube. The fixed piece has wing plates extending outwardly adjacent a bottom edge of the fixed piece. A protective edge extends outwardly beyond the wing plates of the fixed piece. The fixed piece has a protuberance extending outwardly above the central through hole. Two pins each have a length matching the depth of the ring groove. Each of the two pins has a diameter cooperative with an internal space between the fixed piece and the ring groove. The pins extend horizontally at an end of the wing plates.

7 Claims, 8 Drawing Sheets

BABY WALKER WITH SAFETY BRAKE DEVICE

FIELD OF THE INVENTION

The present invention relates generally to a walker, and more particularly to a walker with a safety brake device for baby.

BACKGROUND OF THE INVENTION

The prior art walker is intended to use commonly for babies who are learning to walk. However, if the walker is sit upon by a grown up baby who has learned already to slide or who is sliding too fast, it would happen a dangerous in speed sliding and that it is therefore vulnerable to an accident.

As shown in FIG. 1, the walker base 10 is generally provided with some rotating wheels 11 and further provided with a fixed guide wheel 12. Between the fixed guide wheel 12 and the walker base 10 of the wheel seat is provided with a brake device 14, which is composed of a ring groove 15, a ball 18, a fixed piece 19, a wheel seat 27, and a shaft rod 30 (as shown in FIG. 2 and 3).

The ring groove 15 is provided at one flank of the fixed guide wheel 12 and further provided with a convex shaft tube 16 at the center. On the circular edge of the ring groove 15 is formed a concave round wave of guide ball trough 17.

The ball 18 is provided inside the guide ball trough 17 of the ring groove 15.

The fixed piece 19 is provided with a center through hole 20 for pivoting with the convex shaft tube 16, so as to enable the fixed piece 19 can be put into the ring groove 15. The bottom edge of the fixed piece 19 is formed a small arc edge 21 to cooperate in coordination with the rolling activity of the ball 18 following the small arc edge 21 to the side edge of the fixed piece 19 having a protruding arc 23 of a retainer 22 at one top end. At the top end center through hole 20 of the fixed piece 19 is provided with a convex piece 24, at the bottom end is provided with a hook 31 of an elastic plate 32 at one end thereof. Around outside of the fixed piece 19 is corresponding to the ring groove 15 extended inside having a seal ring 26 of a flange 25.

The wheel seat 27 is corresponding to the convex shaft tube 16 of the ring groove 15 provided with a pivot hole 28. At the walker base 10 outside of the pivot hole 28 is provided with a back pressure insert piece 33. Corresponding to the fixed piece 19 of the convex piece 24 is provided with a slide way 29.

The shaft rod 30, is fastened pivotally between the convex shaft tube 16 of the fixed guide wheel 12 and the pivot hole 28 of the wheel seat 27, is provided with a spread head 34 at one end thereof. The spread head 34 is fixed automatically with the back pressure insert piece 33 and the hook 31 of the elastic plate 32.

With the brake device 14 as described above, the fixed guide wheel 12 and the ring groove 15 take the advantage of the convex shaft tube 16 to revolve pivoting on the shaft rod 30 of the pivot hole 28 of the wheel seat 27, and fastened pivotally with the fixed piece 19 of the convex shaft tube 16 of the ring groove 15. The convex piece 24 is fixed at the slide way 29. The ball 18, which is provided inside the guide ball trough 17 that has formed concave round wave in the ring groove 15, depends on the revolving of the fixed guide wheel 12 enabling it to roll back and forth under the small arc edge 21 of the fixed piece 19. When the fixed guide wheel 12 is revolved, the guide ball trough 17 guides the ball 18 rising up to the protruding arc 23 of the fixed piece 19, and the ring groove 15 (the fixed guide wheel 12) is braking at once.

The prior art walker as described above is defective in design for the ball 18 is limited between the protruding arc 23 of the fixed piece 19 and the guide ball trough 17 of the ring groove 15, so as to cause the power of brake is not enough while braking. The prior art is further defective in design for the protruding arc 23 is easy to be transfigured by the press pressure of the ball 18, so as to cause the power of brake is not effective in operation. As shown in FIG. 3, the ball 18 from the small arc edge 21 of the fixed piece 19 rises to the protruding arc 23 in procedure to brake taking too much time, so as to cause the revolving of the fixed guide wheel 12 is still rolled fast, and needs to have more time in braking.

SUMMARY OF THE INVENTION

The primary objective of the present invention is therefore to provide an improved strong brake device free from the drawbacks of the prior art walker.

In keeping with the principle of the present invention, the foregoing objective of the present invention is attained by the baby walker safety brake device having the ring groove 41 of the fixed guide wheel 12 operating in coordination with the both wing plates 46 and the obliquity arc edge 47 of the fixed piece 44 forming the interval space 48 and the limit space 49 insert to the two pillars 43. With the special structure design in brake device, so that the two pillars 43 can revolve on the interval space 48, or due to the rolling moves up in speed, the two pillars 43 is stopped to revolve on the limit space 49. Furthermore, the ring groove 41 (the fixed guide wheel 12) is braked at once. And taking the advantage of the rolling friction 56 that is provided around the appearance of the two pillars 43, the walker is braked automatically in safety.

The objective, features and functions of the present invention will be readily understood upon a thoughtful deliberation of the following detailed description of the present invention with reference to the accompanying drawings.

DETAILED DESCRIPTION OF THE EMBODIMENT

Figure 1:
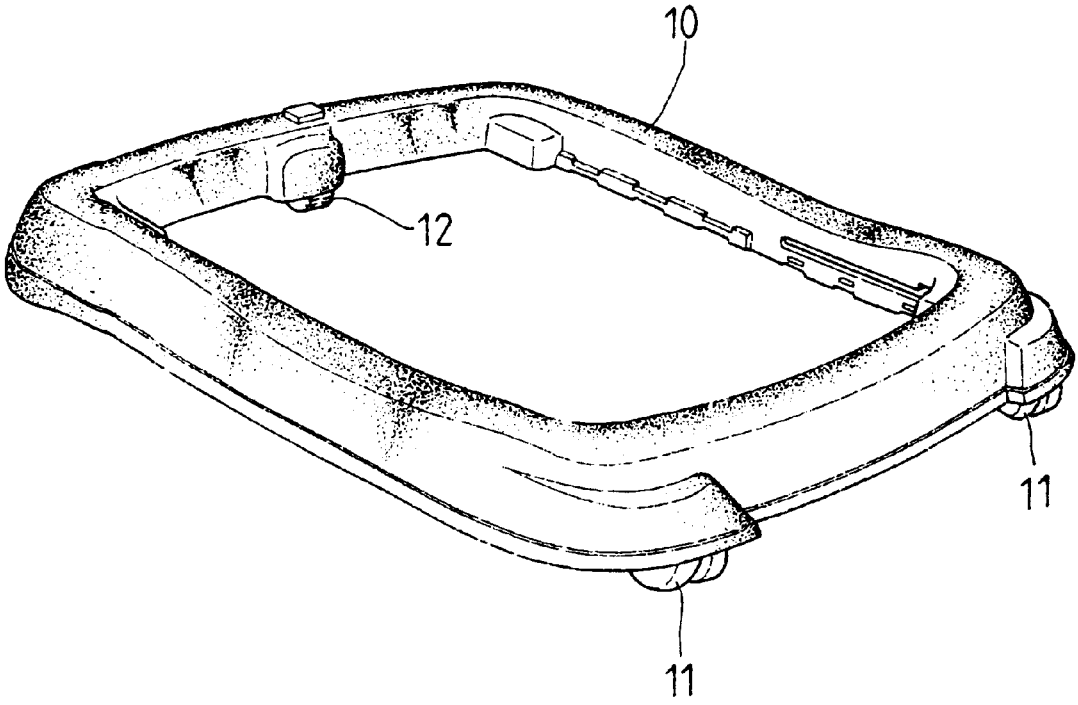
FIG. 1 shows a perspective view of the walker base.
Figure 2:
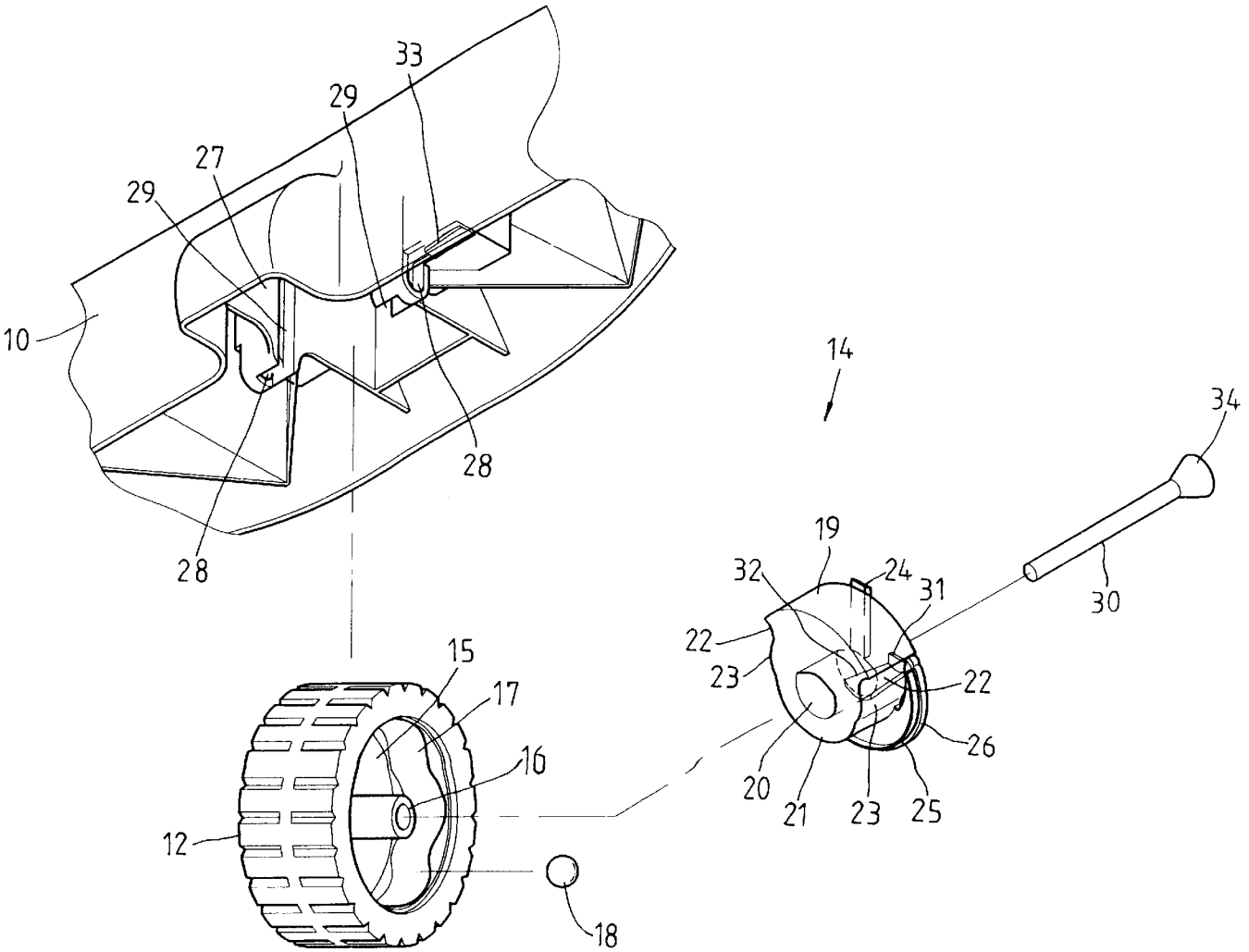
FIG. 2 shows an exploded view of the brake device of the prior art walker.
Figure 3:
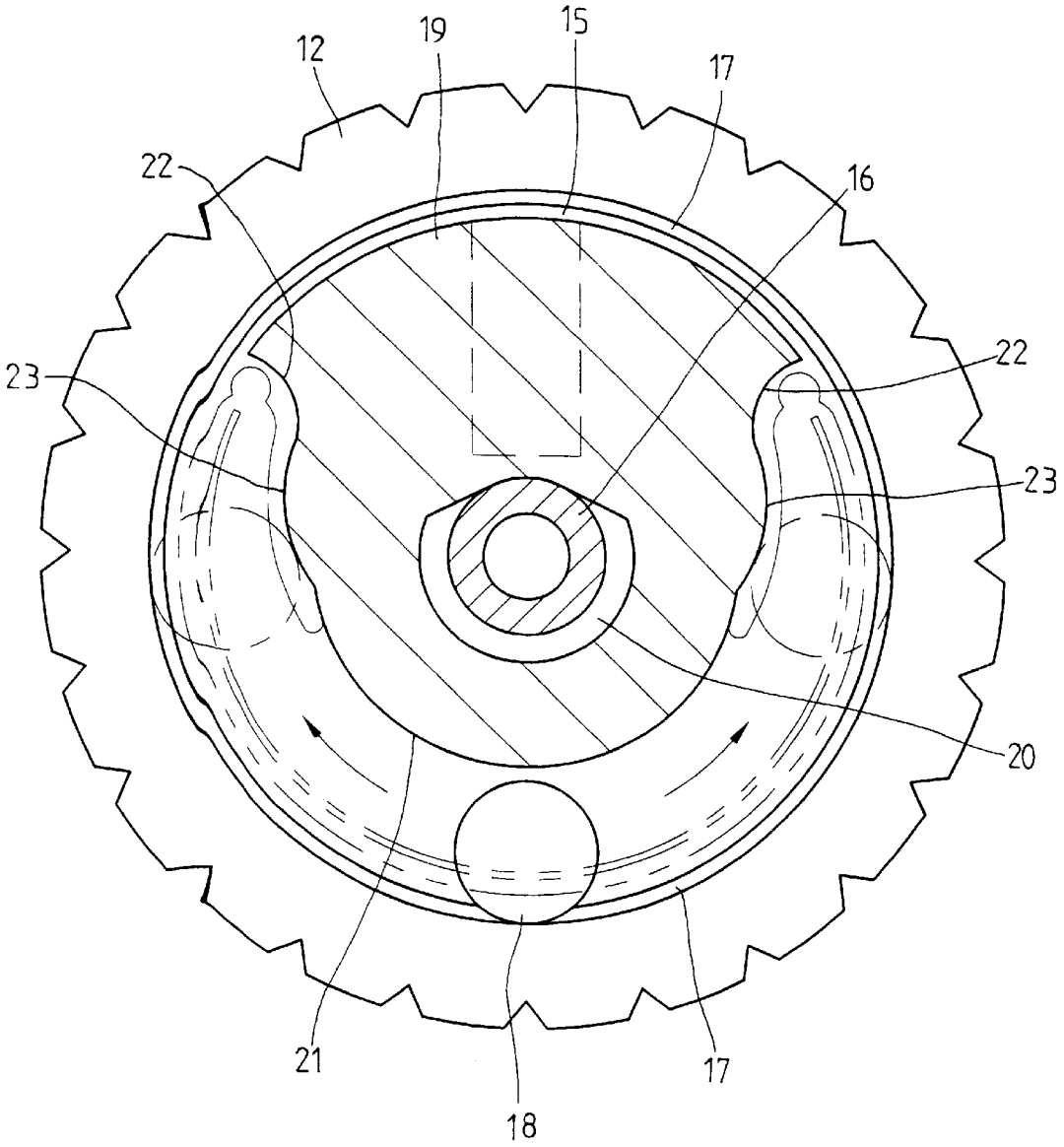
FIG. 3 shows a schematic view of the brake device of the prior art walker in operation.
Figure 4:
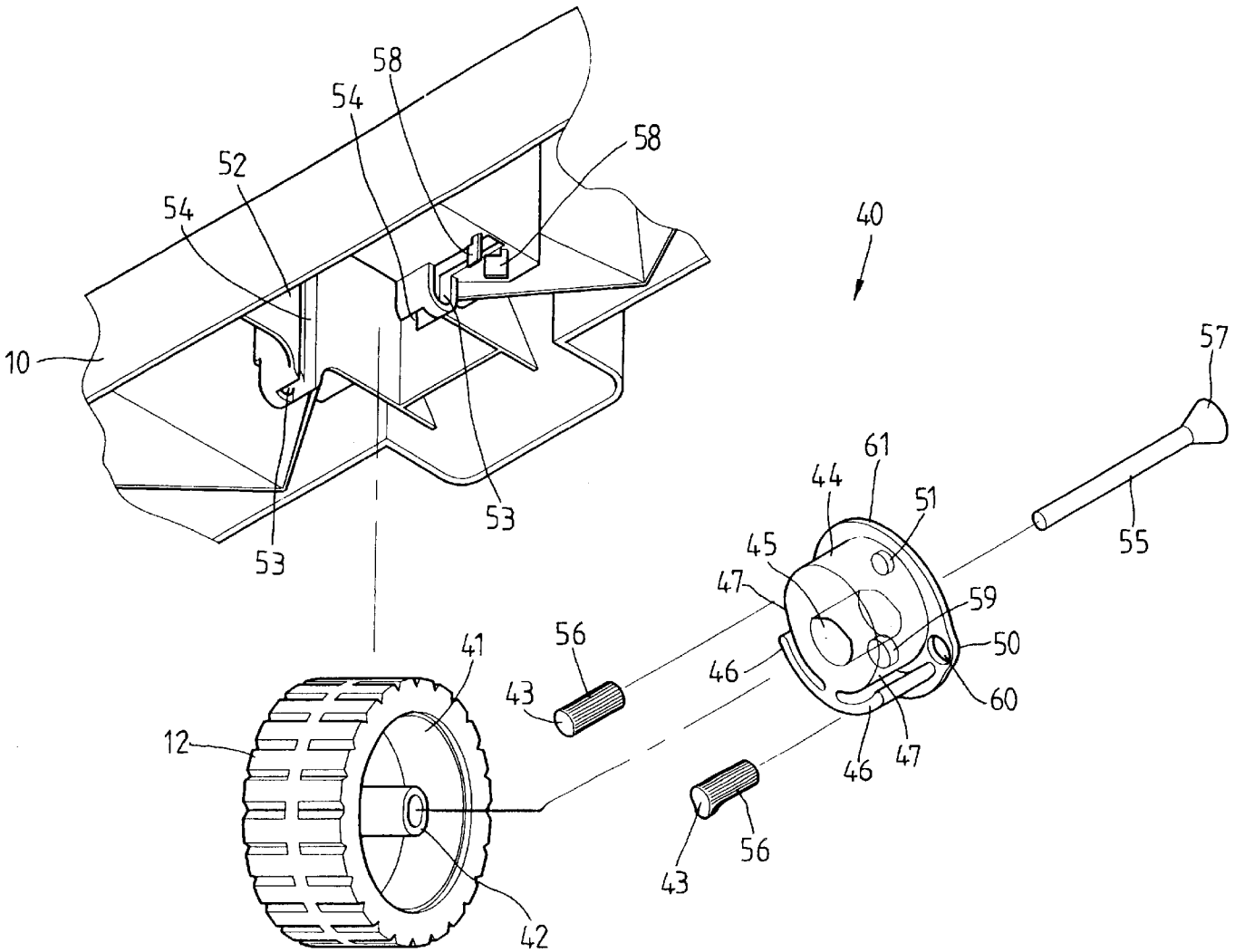
FIG. 4 shows an exploded view of the brake device of the present invention.
Figure 5:
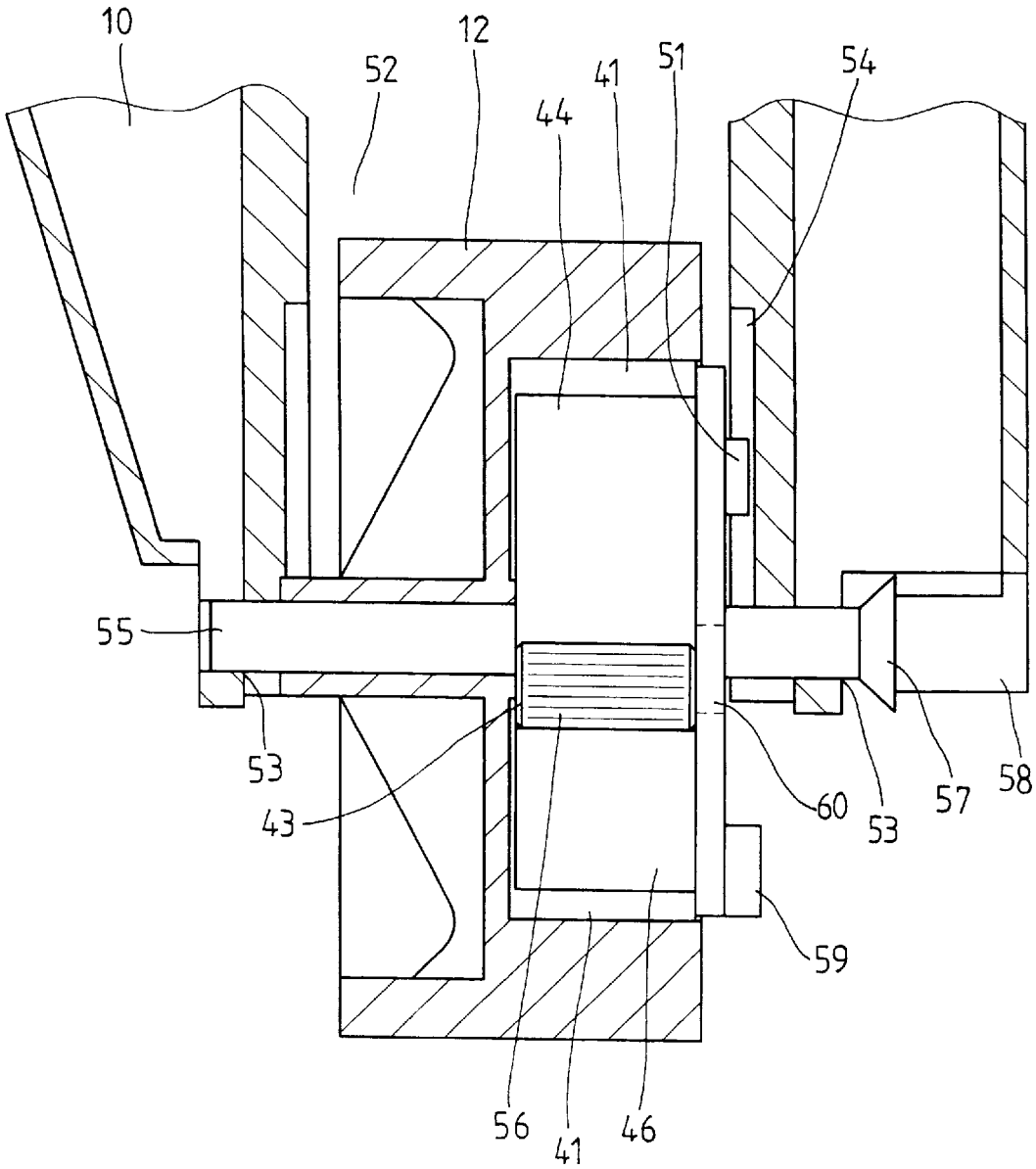
FIG. 5 shows a sectional view of the brake device of the present invention in combination.
Figure 6:
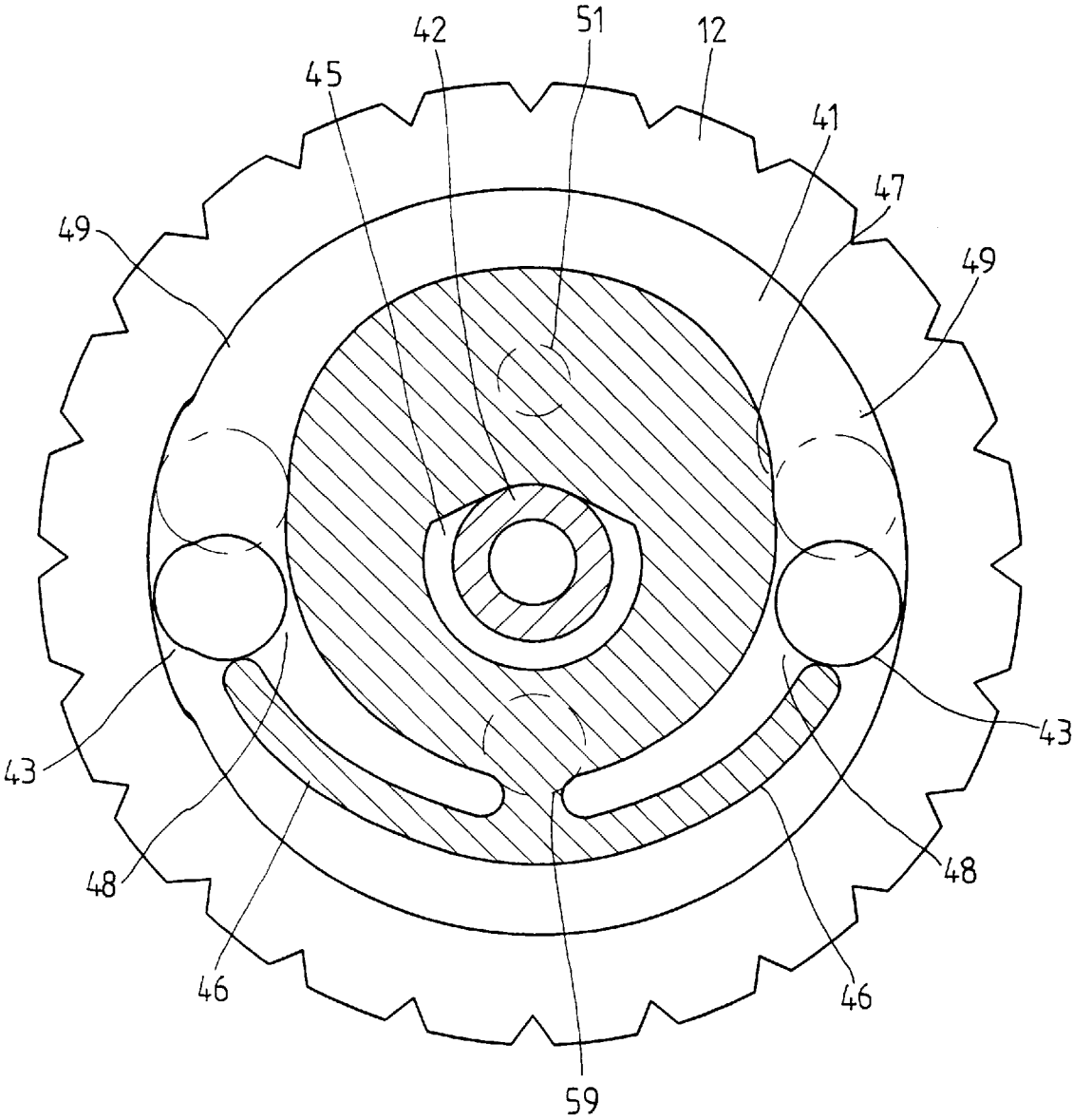
FIG. 6 shows a schematic view of the brake device of the present invention in operation.

As shown in FIGS. 4–6, a baby walker safety brake device embodied in the present invention is composed of a walker base 10, which is provided with some rotating wheels 11 and a fixed guide wheel 12 at the bottom end thereof. Between the fixed guide wheel 12 and the walker base 10 of the wheel seat is provided with a brake device 14, which is composed of a ring groove 41, two pins 43, a fixed piece 44, a wheel seat 52, and a shaft rod 55.

The ring groove 41 is provided at one side of the fixed guide wheel 12 and further provided with a shaft tube 42 at the center.

Two pins 43 having a length which operates in coordination with the depth of the ring groove 41 and the round diameter of them operates in coordination with the interval space 48 that is formed between of the fixed piece 44 and the ring groove 41.

The fixed piece 44, has a thickness which also operates in coordination with the depth of the ring groove 41, is provided with a center through hole 45 for pivoting with the shaft tube 42, so as to enable the fixed piece 44 to be put into the ring groove 41. The bottom edge of the fixed piece 44 corresponding to the ring groove 41 extended to the both sides is formed wing plate 46 each. The two pins 43 are put horizontally on the each wing plate 46. An arc edge 47 is formed at one top end of the wing plate 46. The interval space 48 is broader than the two pins 43 forming from the below section of the arc edge 47 and the round edge of the ring groove 41, on contrary, the limit space 49 is narrower than the two pins 43 forming from the below section of the arc edge 47 and the round edge of the ring groove 41. Outside of the wing plate 46 is extended a protect edge 50 to the interval space 48, the center through hole 45 of the outside fixed piece 44 is provided with a fixed protuberance 51 at one top end.

The wheel seat 52 is corresponding to the shaft tube 42 of the ring groove 41 provided with a pivot hole 53. The wall of the wheel seat 52 is further corresponding to the fixed protuberance 51 provided with a slide way 54.

The shaft rod 55 is fastened pivotally between the shaft tube 42 of the fixed guide wheel 12 and the pivot hole 53 of the wheel seat 52.

With the brake device 40 as described above, the fixed guide wheel 12 and the ring groove 41 take the advantage of the shaft tube 42 to revolve pivoting on the shaft rod 55 of the pivot hole 53 of the wheel seat 52, and fastened pivotally with the fixed piece 44 of the shaft tube 42 of the ring groove 41. The fixed protuberance 51 is fastened inside with the slide way 54 of the wheel seat 52. The two pins 43 are fastened pivotally with the interval space 48 of the both wing plates 46. So as to let the two pins 43 are moved up and fastened with the limit space 49 at once while the fixed guide wheel 12 is revolving. At the same time, the ring groove 41 (the fixed guide wheel 12) is braked in safety.

Taking the appearance of the two pins 43 or the round edge of the ring groove 41 and the arc edge 47 of the fixed piece 44 are all enabling in advantage of the rolling friction 56 to make a brake. The shaft rod 55 is provided with a spread head 57 at one end thereof. On the walker base 10 outside of the center through hole 45 is provided with two back pressure insert pieces 58 relatively, so as the shaft rod 55 makes use of the spread head 57 to slide across through between the two back pressure insert pieces 58 fixing automatically. Around the outside edge of the fixed piece 44 is corresponding to the ring groove 41, extended from the fixed piece 44 having a seal ring 61 relatively in order to prevent other things from coming into the ring groove 41. The protect edge 50 is relatively to the fixed piece 44 provided with a hole 60, so that the fixed piece 44 of the protect edge 50 engageable with the ring groove 41 enabling the two pillars 43 across to the upper side of the wing plate 46 from the hole 60. The center through hole 45 is face to face with the fixed protuberance 51 of the fixed piece 44 and further provided with a resist protuberance 59, which is rather wide than the slide way 54 for discriminating from the fixed protuberance 51, so as to prevent incorrect installation between them.

Figure 7:
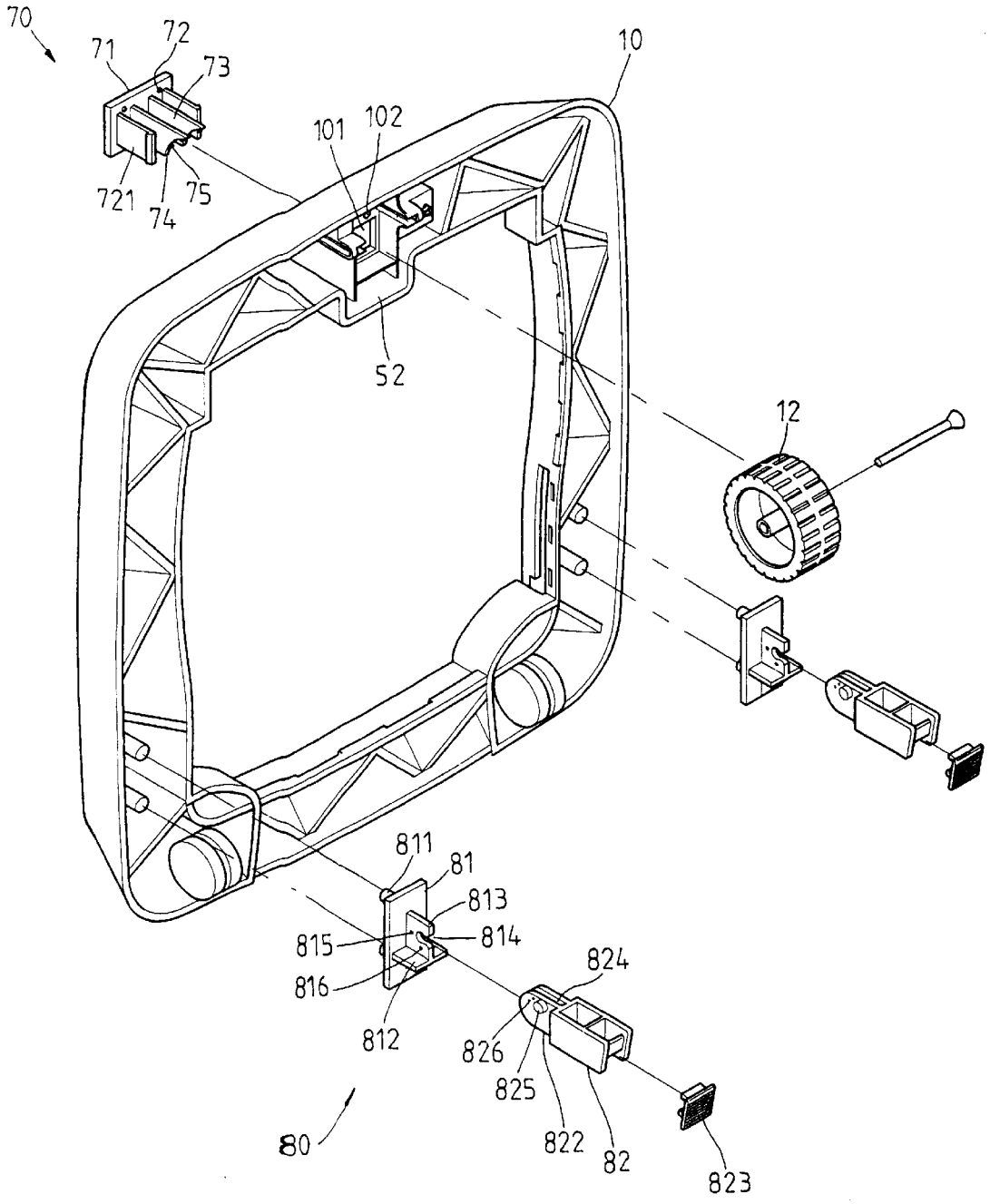
FIG. 7 shows an exploded view of the caliper plate and the control foot seat of the present invention.

As shown in FIG. 7, a baby walker safety brake device embodied in the present invention is of the walker base 10 located at the fixed guide wheel 12 is provided with a guide hole 101, and the walker base 10 is further provided with passable hole 102, so as to enable the guide hole 101 being inserted with a caliper plate 70 from the top end of the walker base 10. The caliper plate 70 is provided with a head plate 71 at the top end thereof. The bottom of the head plate 71 relatives to the passable hole 102 is provided with a flange 72 and a wedge hook 721 at both sides. So that the caliper plate 70 enables to take the advantage of the both sides wedge hook 721 to insert inside the guide hole 101 having front and rear adjusting function on the walker base 10. Located between the two wedge hook 721 at the bottom of the head plate 71 is formed a stable piece 73 towards to the fixed guide wheel 12 at the top end. A concave arc 74 is formed in order to operate in coordination with the wheel arc at the top end of the fixed guide wheel 12. At an appropriate location is provided with a flange block 75.

The baby walker safety brake device embodied in the present invention, at the bottom both sides of the walker base 10 near to the rotating wheels 11 is provided with a control foot seat 80 each. The control foot seat 80 is composed of a fixed seat 81 and a rotary seat 82. The convex piece 811 at the top end of the fixed seat 81 is engaged with the walker base 10 at bottom. At the bottom of the fixed seat 81 is extended with a plate 812, which has provided vertically with a fixed plate 813. At the center of the fixed plate 813 is provided with a hole 814, and the both sides of the fixed plate 813 near to the plate 812 and the fixed seat 81 is provided with two fixed holes (815, 816). The rotary seat 82 is provided with an inserting round arc 822 at one end thereof and provided with a cushion 823 at the other end thereof. The inserting round arc 822 is provided with a long hole 824, and relatives to inside is connected with a pillar 825. Near to the pillar 825 is provided with a protuberance 826, so as to let the inserting round are 822 of the rotary seat 82 take the advantage of the long hole 824 inserting to the fixed plate 813 of the fixed seat 81, and further to let the pillar 825 inserts pivoting with the hole 814 of the fixed plate 813. When the rotary seat 82 is rotated toward to the top end of the fixed seat 81, the protuberance 826 is inserted to fix with the two fixed holes (815, 816) of the plate 812.

The major of the present invention is simplified the ring groove 41 of the fixed guide wheel 12. The wing plate 46 is extended from both sides of the fixed piece 44 enabling the two pins 43 to across horizontally. The arc edge 47 of the fixed piece 44 together with the ring groove 41 have formed the interval space 48 at upper and the limit space 49 at lower. So that to brief the procedure of the two pins 43 revolves from the interval space 48 to the limit space 49. By the rolling friction 56 that is provided at the appearance of the two pins 43 improves braking automatically in safety. While the spread head 57 of the shaft rod 55, the two back pressure insert pieces 58 and the slide way 54 of the walker base 10, and the fixed protuberance 51 of the fixed piece 44 are all making convenient the shaft rod 55 to fasten pivotally with the fixed piece 44. The seal ring 61 of the fixed piece 44 is to prevent other things come into the ring groove 41. The hole 60 is convenient the two pins 43 to install. The resist protuberance 59 relatives to the fixed protuberance 51 to use for discrimination while installing.

Figure 8:
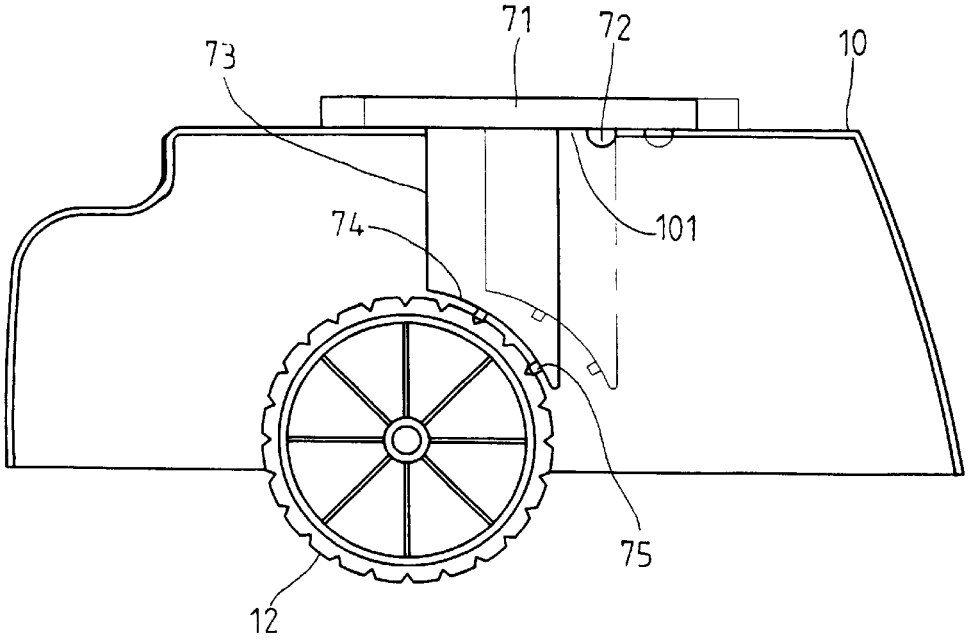
FIG. 8 shows a schematic plane view of the caliper plate of the present invention in operation.
Figure 9:
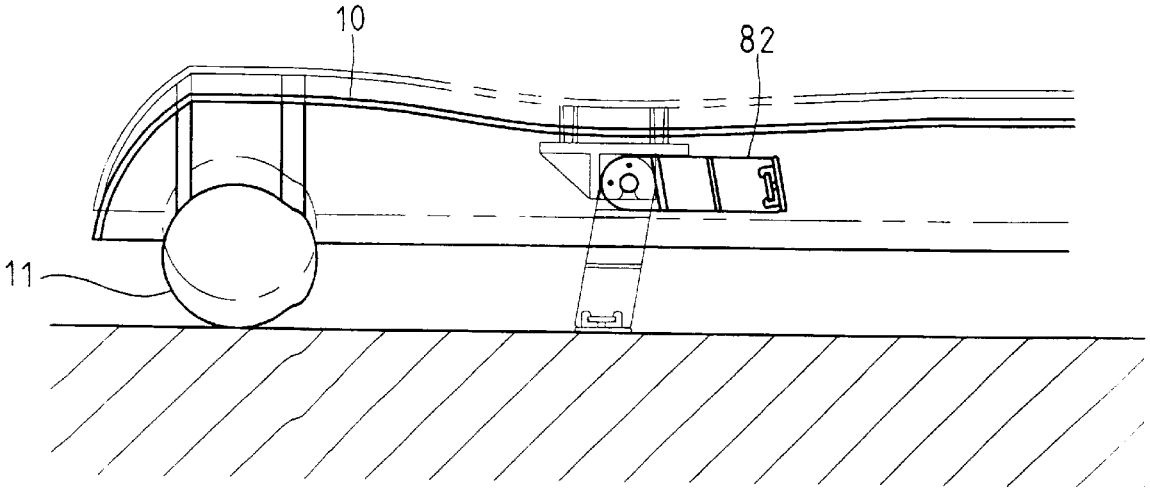
FIG. 9 shows a schematic plane view of the control foot seat of the present invention in operation.

The walker base 10, takes the advantage using of the caliper plate 70 and the control foot seat 80, can let the activity space of the baby walker being limited by the instruction as below:

As shown in FIGS. 8 and 9, to push the head plate 71 of the caliper plate 70 toward inside to the walker base 10, then to link the concave arc 74 of the stable piece 73 and the flange block 75 stopping at the top end of the fixed guide wheel 12. So that the flange 72 of the head plate 71 of the caliper plate 70 is engaged with the edge of the guide hole 101. That can control the fixed guide wheel 12 is not able to rotate, and the activity space of the baby walker is limited. By other words, the baby walker is only using the fixed guide wheel 12 to be supporter while the fixed guide wheel 12 is controlled to rotate, and the rotating wheels 11 can revolve, but revolving only around the place. If needing to let the baby walker is absolutely not able to move, stand up the rotary seat 82 of the control foot seat 80 toward to the ground, and rise up the rotating wheels 11 that near to the walker base 10, so as to let the rotating wheels 11 is hung space, and achieve the baby walker is safety unable to move. The caliper plate 70 can further push to the opposite direction so that the stable piece 73 can leave the fixed guide wheel 12, and the flange 72 re-enter to fix with the passable hole 102 of the guide hole 101 that is near to the walker base 10. That can set free the fixed guide wheel 12 enable to revolve, the control foot seat 80 is set back to the bottom of the walker base 10, so as to reduce the rotating wheels 11 of the walker base 10 contact with the ground, but the baby walker is back in revolving condition.

The embodiment of the present invention described above is to be deemed in all respects as being illustrative and not restrictive. Accordingly, the present invention may be embodied in other specific forms without deviating from the spirit thereof. The present invention is therefore to be limited only by the scopes of the following appended claims.

What is claimed is:

1. A baby walker safety brake device comprising:

a wheel seat having a pivot hole formed therein, said wheel seat having a slide way formed therein;

a fixed guide wheel having a ring groove formed therein on one side thereof, said fixed guide wheel having a shaft tube extending centrally therefrom;

a shaft rod rotatably mounted in said shaft tube, said shaft rod received by said pivot hole of said wheel seat;

a fixed piece received within said ring groove of said fixed guide wheel, said fixed piece having a thickness matching a depth of said ring groove, said fixed piece having a central through hole extending around said shaft tube, said fixed piece having wing plates extending outwardly adjacent a bottom edge of said fixed piece, said fixed piece having a protective edge extending outwardly beyond said wing plates, said fixed piece having a protrusion extending outwardly above said central through hole; and two pins each having a length corresponding to said depth of said ring groove, said two pins each having a diameter cooperative with an internal space between said fixed piece and said ring groove, said two pins respectively extending horizontally at an end of said wing plates, said internal space having a width dimension greater than said diameter, each of said wing plates having an arc shape extending into said internal space, each of said wing plates positioned between said fixed piece and said ring groove so as to form a space therebetween of a lesser size than said diameter of said pins.

2. The device of claim 1, said shaft rod having a spread head at one end thereof, said wheel seat having two back pressure insert pieces affixed adjacent said pivot hole, said spread head extending between said back pressure insert pieces.

3. The device of claim 1, said fixed piece having a seal ring engaged against a surface of said ring groove.

4. The device of claim 1, wherein said protective edge has a hole extending therethrough, said hole having a diameter greater than said diameter of each of said two pins.

5. The device of claim 1, said central through hole of said fixed piece having a face in parallel with a face of said protrusion, said fixed piece having another protrusion of larger size than said protrusion.

6. The device of claim 1, further comprising:

a walker base on which said wheel seat is formed, said walker base having a guide hole and a passable hole, said walker base having a caliper plate received by said guide hole at a top end of said walker base, said caliper plate having a head plate at a top end thereof, said head plate having a flange and a pair of wedge hooks at a bottom thereof adjacent said passable hole, a stable piece being positioned between said pair of wedge hooks at said bottom, said stable piece being adjacent a top end of said fixed guide wheel, said stable piece being cooperative with an outer surface of said fixed guide wheel.

7. The device of claim 1, further comprising:

a walker base on which said wheel seat is formed, said walker base having a control foot seat at a bottom thereof, said control foot seat comprising a fixed seat and a rotary seat, said fixed seat having a convex piece at a top end thereof, said convex piece of said fixed seat being engaged with said bottom of said walker base, a plate being affixed to a bottom of said fixed seat, said plate having a fixed plate extending vertically therefrom, said fixed plate having a hole formed at a center thereof, said fixed plate having holes at opposite sides thereof and adjacent said plate and said fixed seat, said rotary seat having an inserting round arc at one end thereof, said rotary seat having a cushion at another end thereof, said inserting round arc having an elongated hole formed therein, said inserting round arc having a protuberance, said fixed plate received by said elongated hole, said rotary seat having a pillar rotatably received by said elongated hole, said rotary seat rotatable such that said protuberance is engaged with said holes of said fixed plate.

* * * * *